United States Patent [19]

Martin

[11] Patent Number: 4,920,774

[45] **Date of Patent: * May 1, 1990**

[54] SELF-ALIGNING RE-KEYABLE PIN TUMBLER CABINET DOOR LOCK

[75] Inventor: Frank J. Martin, Seattle, Wash.

[73] Assignee: Frank J. Martin Company, Seattle, Wash.

[ * ] Notice: The portion of the term of this patent subsequent to Feb. 13, 2007 has been disclaimed.

[21] Appl. No.: 216,075

[22] Filed: Jul. 7, 1988

Related U.S. Application Data

[63] Continuation-in-part of Ser. No. 40,364, Apr. 17, 1987, abandoned, and a continuation-in-part of Ser. No. 328,748, Mar. 22, 1989, Pat. No. 4,899,563.

[51] Int. Cl.[5] ..... E05B 27/00

[52] U.S. Cl. ..... 70/367; 70/368; 70/370; 70/371; 70/451

[58] Field of Search ..... 70/81, 85, 86, 134, 70/362–371, 451

[56] References Cited

U.S. PATENT DOCUMENTS

| | | | |
|---|---|---|---|
| 4,012,928 | 3/1977 | Dauenbaugh | 70/81 |
| 4,099,397 | 7/1978 | Dauenbaugh | 70/371 |
| 4,630,457 | 12/1986 | Kincaid et al. | 70/369 |
| 4,633,690 | 1/1987 | Foshee | 70/451 |
| 4,756,638 | 7/1988 | Neyret | 70/451 X |

*Primary Examiner*—Gary L. Smith
*Assistant Examiner*—Suzanne L. Dino
*Attorney, Agent, or Firm*—Seed and Berry

[57] ABSTRACT

A re-keyable lock has a forwardly removable cylinder and plug assembly. The cylinder and plug assembly is removably secured to the lock by a setscrew. The setscrew can be removed with conventional and readily available tools. An alignment structure is provided to facilitate alignment of the cylinder and plug assembly with the lock.

2 Claims, 2 Drawing Sheets

SELF-ALIGNING RE-KEYABLE PIN TUMBLER CABINET DOOR LOCK

RELATED APPLICATION

This application is a continuation-in-part of my copending U.S. application Ser. No. 07/040,364, titled RE-KEYABLE PIN TUMBLER DRAWER LOCK AND PIN TUMBLER CABINET DOOR LOCK, filed Apr. 17, 1987, now abandoned, and a cont-in-part of U.S. application Ser. No. 07/328,748, filed 3/22/89, now issued as U.S. Pat. No. 4,899,563.

TECHNICAL FIELD

The invention relates to pin tumbler cabinet door locks. More specifically, the invention relates to locks having easily removable cylinder and cylinder plug assemblies.

BACKGROUND ART

Drawer and cabinet door locks, in contrast to main entry locks for doors, etc., have not been designed to facilitate rekeying of the lock. It has generally been accepted in the industry that the cost of replacing an entire drawer or cabinet door lock is less than the labor cost of disassembling and replacing lock pin tumblers to rekey the lock. Therefore, drawer and cabinet door locks are typically constructed with nonremovable cylinder and cylinder plug assemblies. In some instances, it may be possible for a locksmith to disassemble and rekey such a lock, but such an operation is not cost-effective and is extremely difficult to do. This type of rekeying effect is not cost-justified because removal of the cylinder and plug assembly requires disassembly of the entire lock resulting in a loss of syncronization of cam mechanisms, bolt springs and other internal bolt driving mechanisms. Reassembly and retiming of the lock are sufficiently complex operations to require the use of timing charts and specialized tools provided to the locksmith by the lock manufacturer.

U S. Pat. Nos. 3,589,152, to Glass and Orr, and U.S. Pat. No. 3,824,817, to Orr, both describe cabinet door locks which have removable cylinder and plug assemblies. This feature is provided primarily to permit finishing of the furniture in which the locks are installed. Prior to installation of the cylinder and plug assemblies, a bolt housing is installed in the furniture. The furniture is then shellacked or otherwise finished. The cylinder and plug assembly is then attached to the, bolt housing. This prevents shellac or other finishing materials from entering the pin tumblers of the cylinder and plug assemblies.

The above-described removable cylinder and plug assemblies are not well adapted for rekeying by locksmiths and others. Each of the above two designs requires that at least one specialized external tool be used to disengage the cylinder and plug assemblies from the bolt housings. Such an arrangement is not commercially suitable for locksmiths because of the requirement for a specialized tool. Furthermore, each of the above two described removable cylinder and plug assemblies utilizes a complex design which is expensive to manufacture. This places the manufacturer at a competitive disadvantage with respect to non-rekeyable drawer locks and cabinet door locks.

Therefore, a need exists for an inexpensive pin tumbler drawer and cabinet door lock which has a removable cylinder and plug assembly. Preferably, this design would be sufficiently inexpensive so as to be competitive with non-rekeyable drawer and cabinet door locks. Removal of the cylinder and plug assembly should not require specialized tools and should be able to be accomplished in one minute or less.

DISCLOSURE OF THE INVENTION

It is the object of the present invention to provide a drawer and cabinet door lock which has a removable cylinder and plug assembly for rekeying.

It is also an object of the present invention to achieve the above object while facilitating re-installation of the cylinder and plug assembly within the lock.

It is yet another object of the present invention to achieve the above two objects without requiring the use of any specialized tools by the locksmith or others.

The invention achieves these advantages, and other objects and advantages which will become apparent from the description which follows, by providing a rekeyable lock with a unitary shell having a cylinder housing which defines a forward opening. The forward opening is sized to removably receive a cylinder and plug assembly so that the cylinder and plug assembly can be forwardly removed through the forward opening.

In the preferred embodiment, the cylinder housing defines a threaded aperture, and the cylinder and plug assembly has a threaded bore which is registrable with the threaded apertured. A setscrew is engageable with the aperture and bore to releasably secure the cylinder and plug assembly within the cylinder housing. A conventional screwdriver may be used to remove the setscrew. An aligning lug is preferably provided within the cylinder housing to mate with a corresponding alignment groove on the cylinder and plug assembly. The aligning lug and corresponding alignment groove facilitate alignment of the threaded bore in the cylinder and plug assembly with the threaded aperture in the cylinder housing. The invention is adaptable to a variety of lock designs, and is particularly useful with cabinet door locks of the type which have cam mechanisms which would otherwise become unseated and unsyncronized if the cylinder housing were removed from a bolt housing containing the cam mechanism. The maintenance of proper syncronization of all internal operating parts of the lock eliminates the necessity of retiming the lock.

BEST MODE FOR CARRYING OUT THE INVENTION

Figure 1:
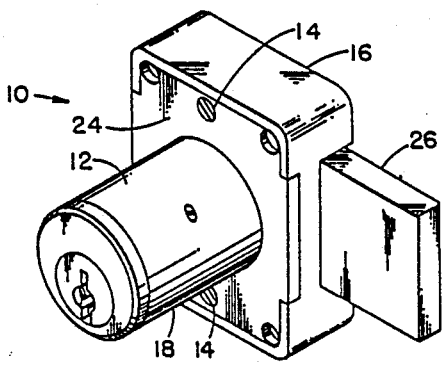
FIG. 1 is an isometric view of a cabinet door lock employing the present invention.
Figure 2:
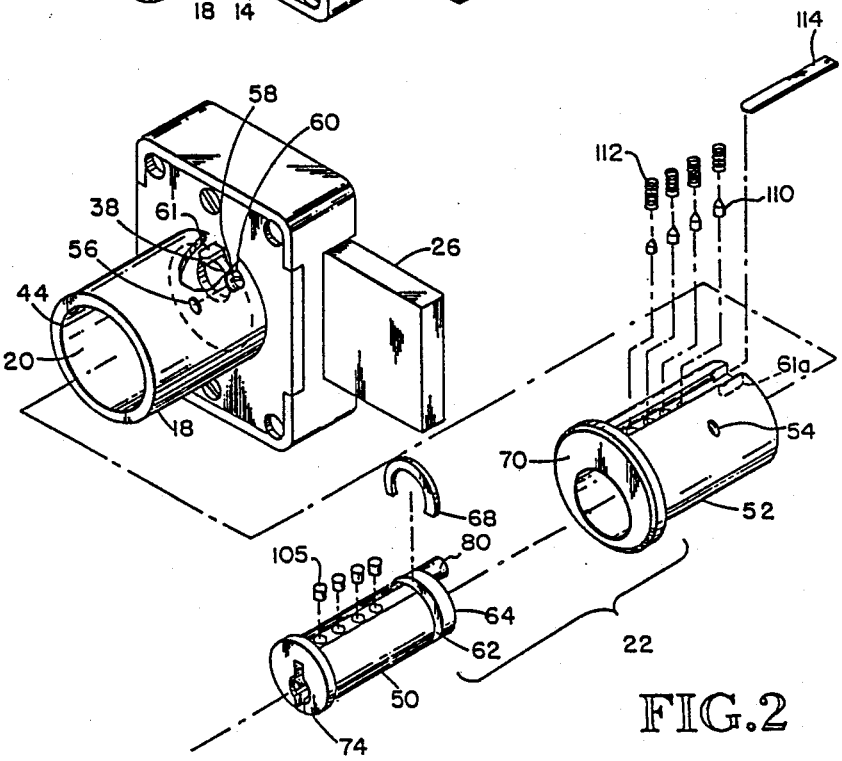
FIG. 2 is an exploded isometric view of the cabinet lock of FIG. 1.
Figure 3:
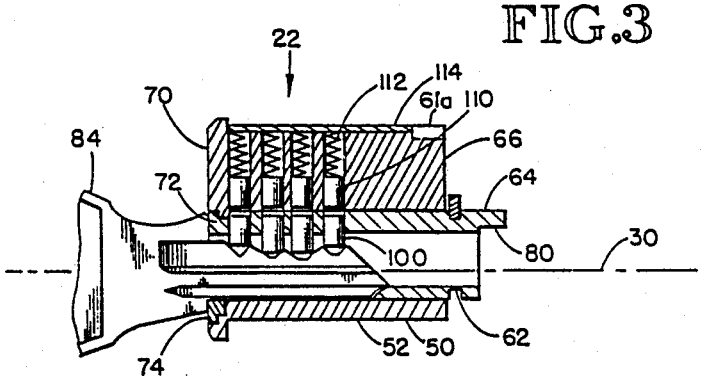
FIG. 3 is a sectional elevational view of a cylinder and plug assembly.
Figure 4:
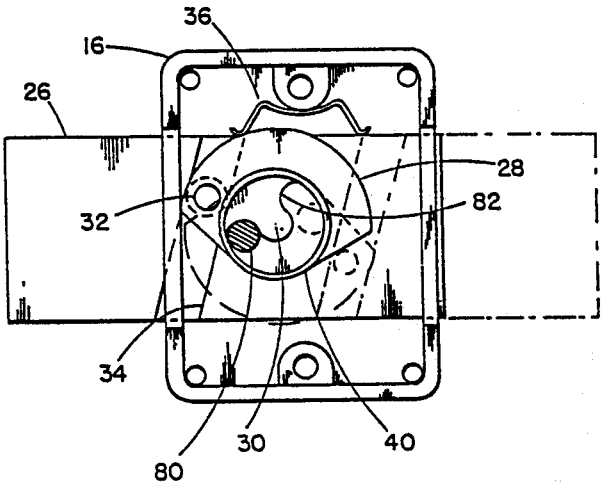
FIG. 4 is a front elevational view of the cabinet lock s in FIG. 1 with the unitary shell and cylinder and plug assembly removed therefrom.

A cabinet door lock, employing the concept of the present invention, is generally indicated at reference numeral 10 in FIG. 1, and is further illustrated in FIGS. 2 through 4. The cabinet door lock has a unitary shell 12 which is removably connected by screws 14, or other conventional means, to a bolt housing 16.

The unitary shell 12 has a cylinder housing portion 18 which defines a cylindrical cavity 20 for slidably receiving a cylinder and plug assembly 22. The unitary shell also has a bolt housing cover 24 which, together with the bolt housing 16, contains a movable bolt 26. As best seen in FIG. 4, the bolt housing also contains a cam mechanism 28 which is rotatable about a cam rotation axis 30 between the solid-line and dotted-line positions shown in FIG. 4.

Cam mechanism 28 has a bolt drive pin 32 which is displaced from the cam rotation axis 30. The bolt drive pin is slidably engaged with a drive slot 34 in the bolt 26. Rotation of the cam mechanism 28 about the cam rotation axis 30 causes the bolt drive pin 32 to move between the solid- and dotted-line position shown in FIG. 4 to drive the bolt 26 as shown. A spring 36 is positioned within the bolt housing 16 to provide frictional resistance to movement of the bolt.

The cam mechanism 28 is not constrained for rotation about an axis by any structure within the bolt housing 16. To constrain the cam mechanism for rotation about an axis, the unitary shell 12 is provided with a rearward opening 38. The rearward opening is positioned to engage and permit rotary movement of a raised circular rim 40 on the cam mechanism 28. The center of the circular rim 40 is coincident with the cam rotation axis 30. Thus, the cam mechanism 28 is positively positioned ,within the bolt housing 16 only when the unitary shell 12 is attached to the bolt housing, as shown in FIGS. 1 and 2.

Thus, it is highly preferred that the cylinder and plug assembly 22 be forwardly removable through a forward opening 44 in the cylinder housing portion 18 without removing the unitary shell 12 from the bolt housing 16. In this way, the cylinder and plug assembly 22 can be removed from the unitary shell 12, rekeyed, and reinserted into the unitary shell without disturbing the position of the cam mechanism 28.

The cylinder and plug assembly 22 has a plug 50, which is rotatably received in a cylinder 52. The cylinder is provided with a threaded bore 54, which is registrable with a threaded aperture 56 in the cylinder housing portion 18. A setscrew 58 having provisions 60 for a conventional slotted screwdriver head is engageable within the aperture and bore to removably secure the cylinder 52 with the cylinder housing portion 18.

As best seen in FIG. 2, the cylinder housing portion 18 of the unitary shell 12 is preferably provided with an aligning lug 61 adapted to mate with a corresponding aligning groove 61(a) in the cylinder 52. The forward end of the aligning lug is preferably rounded so that the aligning lug guides the cylinder and plug assembly 22 into a seated position within the cylinder housing portion 18. The threaded bore 54 is thus automatically aligned with the threaded aperture 56, and the cam drive pin 80 automatically engaged with the cam mechanism 28, when the cylinder and plug assembly 22 is inserted into the cylindrical cavity 20. The aligning lug has a length of approximately 3/32" and protrudes into the cylinder cavity approximately 0.10". The corresponding aligning groove 61(*a*) on the cylinder 52 has corresponding dimensions.

The plug 50 has an annular groove 62 on a rearwardly extending portion 64 of the plug. When the plug 50 is inserted into the cylinder 52, the annular groove 62 and rearwardly extending portion 64 protrude, from a rear end 66 of the cylinder 52. A C-shaped clip 68 is seated in the groove 62 after the plug 50 is inserted into the cylinder 52 to axially fix the plug within the cylinder. A forward end 70 of the cylinder 52 has a recessed circular edge 72 which abuts a rim 74 at the forward edge of the plug 50 to limit the rearward movement of the plug with respect to the cylinder. The rearwardly extending portion 64 of the plug 50 also has a cam drive pin 80 displaced from the position of the cam rotation axis 30. The cam drive pin is engageable with a contour 82 on the cam mechanism 28 so as to rotatably drive the cam mechanism when a key 84 is inserted into the plug 50 and rotated therewith.

The plug 50 has conventional pin tumblers 100 which are engageable with conventional drivers 110 and driver springs 112 in the cylinder 52 to uniquely identify the cabinet door lock 10 with a particular key. The cylinder 52 may be provided with a slidable cover 114, or any other conventional means, for maintaining compression in the driver springs 112. The slidable cover extends forwardly from the corresponding groove 61(*a*) to the forward end 70 of the cylinder 52.

The above-described structure permits easy removal of the cylinder and plug assembly 22 from the cylinder housing portion 18 without removing the unitary shell 12 from the bolt housing 16. The pin tumblers 100 within the plug 50 may then be exchanged by a locksmith to rekey the plug. Upon reinsertion of the rekeyed plug into the cylinder 52, the cylinder and plug assembly 22 is automatically and accurately aligned and engaged with cam mechanism 28. The threaded aperture 56 is also automatically and accurately aligned with the threaded bore 54 simultaneously. The cylinder and plug assembly may then be resecured in the cylinder housing portion 18 by merely retightening the setscrew 58. The speed with which even a novice locksmith can perform this operation has been found to economically justify rekeying locks of this type. In prior art structures where the cylinder and plug assembly was not forwardly removable from the lock and/or where the removal of the plug 50 from the lock required removal of the bolt housing cover from the bolt housing, subsequent misalignment of the cam mechanism 28 resulted in an unacceptably long reassembly time for the lock after plug rekeying. The automatic realignment capability of the present invention cooperates with the unitary shell 12 design and the set screw retention technique to maintain the timing of the lock during rekeying of the plug 50 and to eliminate the other above-described prior art limitations.

It is also contemplated that the invention as described above be applied to inexpensive locks of different varieties. For example, the aligning lug 61 and corresponding groove 61(*a*) could be employed with the drawer lock invention shown in FIG. 5 of my co-pending application Ser. No. 07/040,364, titled RE-KEYABLE PIN TUMBLER DRAWER LOCK AND PIN TUMBLER CABINET DOOR LOCK. Therefore, the invention is not to be limited by the above description, but is to be determined in scope by the claims which follow.

I claim:

1. A re-keyable lock, comprising:

a bolt housing including a movable bolt operatively engaged with a rotatable cam mechanism having a rotary guide portion;

a unitary shell having a bolt housing cover connected to the bolt housing, a cylinder housing having a radially directed circular aperture, a forward opening sized to removably receive a cylinder and plug assembly, a rearward opening sized and positioned to receive the guide portion of the cam mechanism to guide rotation of the cam mechanism about a cam rotation axis, and a forwardly directed, aligning lug extending inwardly from the cylinder housing and forwardly towards the forward opening;

a cylinder and plug assembly having a threaded bore positioned so as to be alignable with the circular aperture, a forward end and a rearward end with a rearwardly directed alignment groove positioned to mate with the aligning lug and to prevent rotation of the cylinder and plug assembly with respect to the unitary shell, wherein the cylinder and plug assembly is removable and reinsertable through the forward opening without rotating the cylinder and plug assembly so that the threaded bore and circular aperture are automatically aligned and so that the cylinder and plug assembly is simultaneously engaged with the rotatable cam mechanism quickly and accurately; and a screw engageable through the circular aperture with the treaded bore to rotatably and longitudinally fix the cylinder and plug assembly within the cylinder housing.

2. The re-keyable lock of claim 1 wherein the aligning lug has a curved forward end to guide the alignment lug into engagement with the alignment groove.

* * * * *